US008092163B2

(12) United States Patent
Shapiro et al.

(10) Patent No.: US 8,092,163 B2
(45) Date of Patent: Jan. 10, 2012

(54) TURBINE STATOR MOUNT

(75) Inventors: Jason David Shapiro, Methuen, MA (US); Victor Hugo Silva Correia, Milton Mills, NH (US)

(73) Assignee: General Electric Company, Schenectady, NY (US)

( * ) Notice: Subject to any disclaimer, the term of this patent is extended or adjusted under 35 U.S.C. 154(b) by 914 days.

(21) Appl. No.: 12/058,972

(22) Filed: Mar. 31, 2008

(65) Prior Publication Data

US 2009/0246012 A1 Oct. 1, 2009

(51) Int. Cl.
*F01D 25/28* (2006.01)

(52) U.S. Cl. ..... 415/189; 415/209.2; 415/209.3; 415/213.1

(58) Field of Classification Search ..... 415/189, 415/209.2, 209.3, 213.1
See application file for complete search history.

(56) References Cited

U.S. PATENT DOCUMENTS

| | | | | |
|---|---|---|---|---|
| 3,765,791 | A | 10/1973 | Trappmann | |
| 4,883,405 | A | 11/1989 | Walker | |
| 5,176,496 | A | 1/1993 | Correia et al. | |
| 5,224,822 | A | 7/1993 | Lenahan et al. | |
| 5,248,240 | A | 9/1993 | Correia | |
| 5,249,920 | A | 10/1993 | Shepherd et al. | |
| 5,271,714 | A | 12/1993 | Shepherd et al. | |
| 5,343,694 | A | 9/1994 | Toborg et al. | |
| 5,372,476 | A | 12/1994 | Hemmelgarn et al. | |
| 6,932,568 | B2 * | 8/2005 | Powis et al. | 415/189 |
| 7,112,042 | B2 | 9/2006 | Tatsumi et al. | |
| 7,600,967 | B2 * | 10/2009 | Pezzetti et al. | 415/173.1 |
| 2009/0038311 | A1 | 2/2009 | Snook et al. | |

FOREIGN PATENT DOCUMENTS

| | | | |
|---|---|---|---|
| EP | 1452693 | A2 | 9/2004 |
| GB | 2260789 | A | 4/1993 |

OTHER PUBLICATIONS

GB 0904762.2, Great Britain Search Report and Written Opinion, Jul. 17, 2009.

* cited by examiner

*Primary Examiner* — Edward Look
*Assistant Examiner* — Liam McDowell
(74) *Attorney, Agent, or Firm* — General Electric Company; David J. Clement

(57) ABSTRACT

A reaction mount system that provides support for the stator vane for a gas turbine engine is described comprising a stator hanger located on an outer band at a first location and a stator stopper located at a second location that is located circumferentially apart from the first location. A stator assembly for a gas turbine engine is described, the stator assembly comprising a stator vane having an airfoil, an outer band located on a radially outer end of the airfoil, a shroud hanger located axially adjacent to the outer band, the shroud hanger comprising a post wherein at least a portion of the post extends in an axial direction over a portion of the outer band, and a reaction mount system located on the outer band wherein the reaction mount system engages with the post to provide support for the stator vane.

8 Claims, 7 Drawing Sheets

TURBINE STATOR MOUNT

BACKGROUND OF THE INVENTION

This invention relates generally to gas turbine engine components, and more specifically to mounting of stators in turbine engines.

Gas turbine engines typically include a core engine having a compressor for compressing air entering the core engine, a combustor where fuel is mixed with the compressed air and then burned to create a high energy gas stream, and a first or high pressure turbine which extracts energy from the gas stream to drive the compressor. In aircraft turbofan engines, a second turbine or low pressure turbine located downstream from the core engine extracts more energy from the gas stream for driving a fan. The fan provides the main propulsive thrust generated by the engine.

An annular turbine nozzle is located between the combustor and high pressure turbine and between stages of the turbine. The turbine nozzle includes a pair of radially spaced inner and outer bands disposed concentrically about a longitudinal axis of the core engine and airfoils supported between the inner and outer annular bands. In the annular turbine nozzle assembly, the airfoils are arranged in circumferentially spaced relation from one another and extend in radial relation to the core engine axis. The annular turbine nozzle assembly is formed by a plurality of arcuate segments (alternatively referred to herein as "stator vane" or "stator vanes") which fit end-to-end together to form the 360 degree circumferentially extending nozzle assembly. Each turbine nozzle segment includes arcuate segments of the inner and outer bands and one or more airfoils mounted between the inner and outer band segments.

The turbine nozzle provides the function of directing and/or re-directing hot gas flow from the combustor into a more efficient direction for impinging on and effecting rotation of the rotor stages of the turbine. The directing process performed by the nozzle also accelerates gas flow resulting in a static pressure reduction between inlet and outlet planes and creates high pressure loads and moments on the nozzle and its support system. Additionally, the turbine nozzle and its support systems also experience loads and moments due to the high thermal gradients from the hot combustion gases and the coolant air at the radial support surfaces.

In conventional nozzle support systems, the nozzle segments are attached by bolted joints or a combination of bolts and some form of clamping arrangement to an engine support structure. Such arrangements, however, create significant bending stresses in the nozzle and support due to mechanical loads and moments experienced by the nozzle airfoils and due to differential thermal expansion and contraction. Furthermore, holes required for receiving the bolts inherently create stress concentrations and may provide potential leakage paths. And, the nuts and bolts required for the assembly add undesirable weight to the engine and increase assembly and disassembly time.

In some designs of smaller turbine engines, turbine nozzles are supported only at their radially outer band in essentially a cantilever type arrangement since their radially inner band extends adjacent a rotating engine structure to which the turbine rotor stages are attached. In some stages, such as the first stage nozzle, the nozzle is attached to the engine stationary structure via a radially inner mount or flange structure coupled to the inner band. The radially outer band is not mechanically retained but is supported against axial forces by a circumferential engine flange. In other stages, such as stage 2 turbine of an engine, the turbine nozzle may be attached at its radially outer band but be free at its radially inner band. In either design, the use of bolts and clamps at circumferential locations about a turbine nozzle band act as a restriction to the band, which band is hotter than the structure to which it is attached, causing radial bowing of the outer band of the nozzle, causing out-of-roundness and stressing of the airfoils attached to the band. Such stressing of the airfoils may lead to formation of cracks in the airfoil.

A need exists for the development of alternative designs methods which will provide improvements in mounting and supporting stator components such as turbine nozzle segments to the engine support structure. Accordingly, it would be desirable to have a method and system for mounting static components in a turbine engine, such as a stator vane, to the engine support structure that react the loads and moments without using bolts and nuts. It is desirable to have a reaction mount system for a turbine stator component such that the stator can be easily replaced in an assembly.

BRIEF DESCRIPTION OF THE INVENTION

The above-mentioned need or needs may be met by exemplary embodiments which provide a system for supporting removable static components in a turbine engine. A reaction mount system that provides support for a stator vane is described, comprising a stator hanger located on an outer band at a first location and a stator stopper located at a second location that is located circumferentially apart from the first location. A stator assembly for a gas turbine engine is described, the stator assembly comprising a stator vane having an airfoil, an outer band located on a radially outer end of the airfoil, a shroud hanger located axially adjacent to the outer band, the shroud hanger comprising a post wherein at least a portion of the post extends in an axial direction over a portion of the outer band, and a reaction mount system located on the outer band wherein the reaction mount system engages with the post to provide support for the stator vane. The stator hanger comprises a stem, a hammer and a hanger claw.

In one embodiment, an antirotation tab is located on the hanger claw. In an alternative embodiment, an anti-rotation tab is located on the reaction mount.

A shroud hanger is described comprising an inner rail, an outer rail located radially apart from the inner rail and at least one post radially located between the inner rail and the outer rail wherein a portion of the post extends in an axial direction such that it is capable of providing support to an adjacent stator component.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
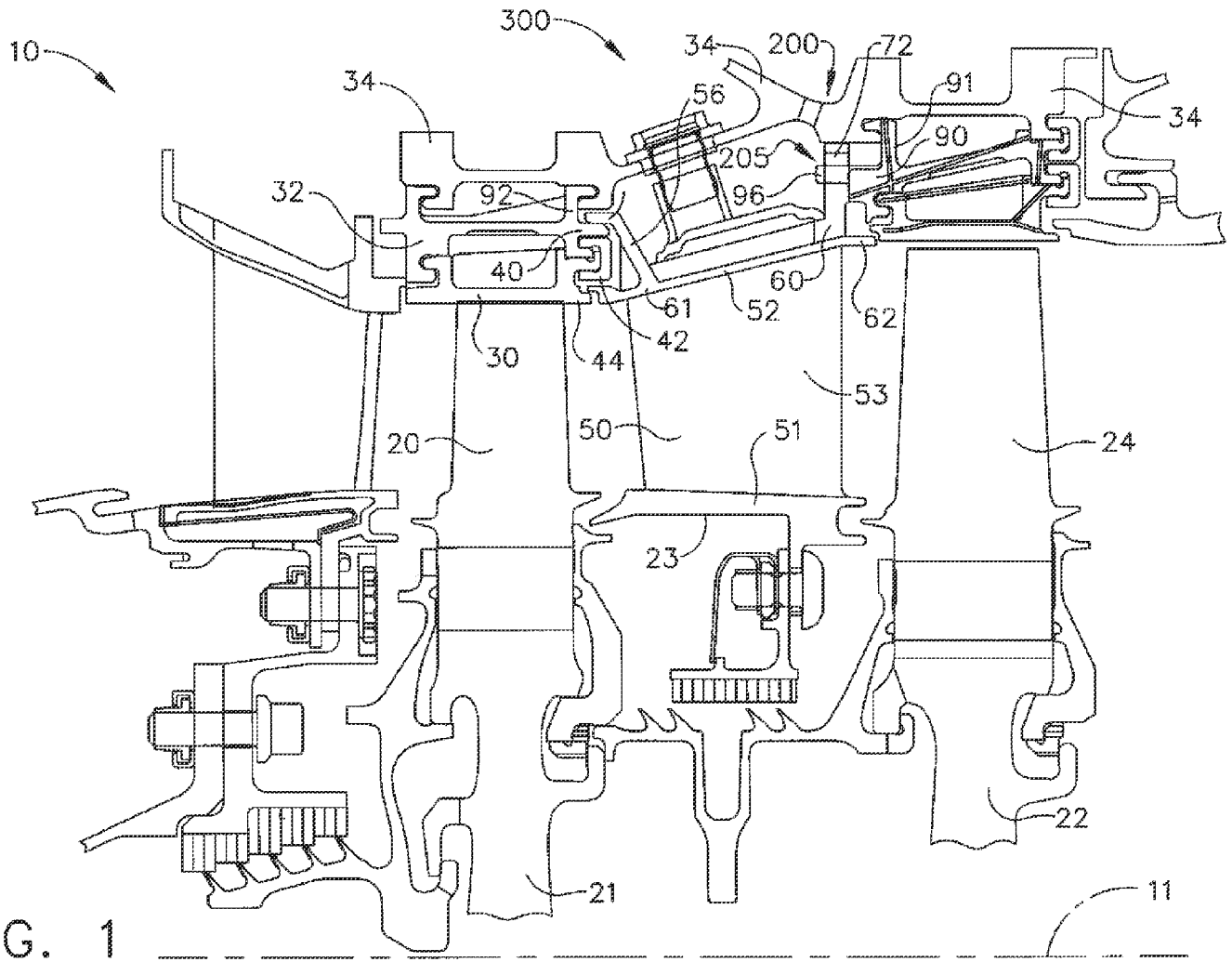
FIG. 1 is a longitudinal cross sectional illustration of a portion of a gas turbine showing the rotors and stators including an exemplary embodiment of the present invention.

Referring to the drawings wherein identical reference numerals denote the same elements throughout the various views, FIG. 1 shows a longitudinal cross sectional illustration of a portion of an exemplary gas turbine 10 showing the rotors and stators including an exemplary embodiment of the present invention. The exemplary gas turbine 10 shown in FIG. 1 comprises a stage 1 turbine rotor 21, a stage 2 turbine rotor 22, and a stage 2 turbine nozzle 23 located axially in between them. Turbine blades 20 and 24 are circumferentially arranged around turbine centerline 11 on the rims of the stage 1 and stage 2 rotors respectively. The exemplary embodiments shown herein show support systems 300 in turbines for supporting static components, such as turbine nozzles 23, using adjacent static structures 91, 92 such as shroud hangers 32, 90.

Figure 2:
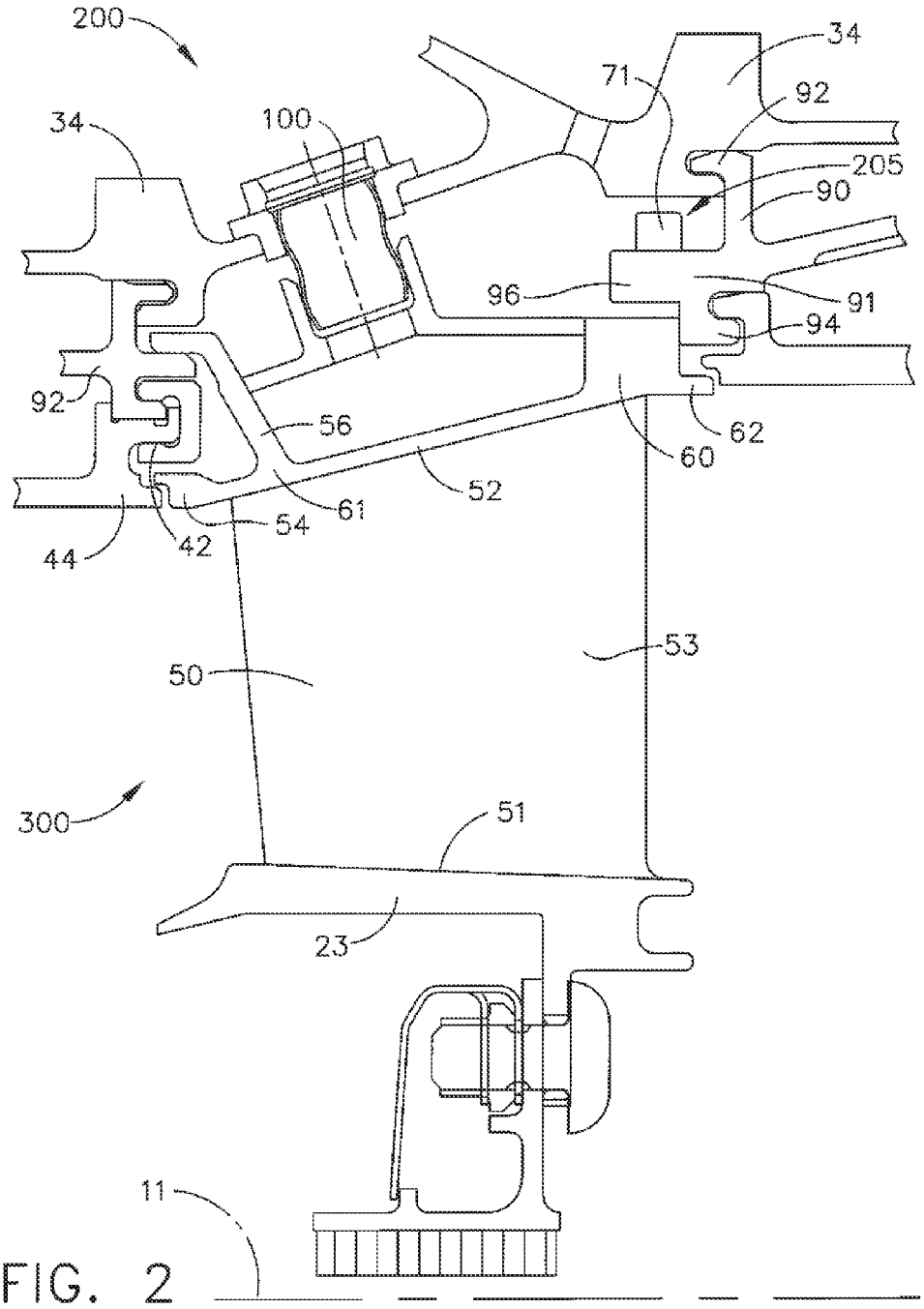
FIG. 2 is a longitudinal cross sectional illustration of the stator components in the gas turbine shown in FIG. 1, including an exemplary embodiment of the present invention.

FIG. 2 shows an enlarged view of the stage 2 turbine nozzle that is shown in FIG. 1. The stage 2 turbine nozzle 23 comprises an inner band 51, an outer band 52 and an airfoil 50 that extends between the inner band 51 and the outer band 52. The turbine nozzles shown herein have one airfoil between the inner band and the outer band. However, in other embodiments of the present invention, it is possible to have a plurality of airfoils in a turbine nozzle segment, between the inner band and the outer band. The inner band 51 and the outer band 52 form the flow path for the combustion gases. The turbine nozzle airfoil 50 may be hollow (such as, for example, shown in FIG. 5) so that cooling air supplied from a spoolie 100 can be circulated through the hollow airfoil 50. The nozzle segment 23 including the outer band may be made of a single piece of casting having the vane airfoils, the outer band and the inner band. Alternatively the nozzle segment may be made by suitable conventional methods of joining, such as brazing, individual sub-components such as vane airfoils, the outer band and the inner band.

The outer band 52 and inner band 51 of each nozzle segment 23 have an arcuate shape so as to form an annular flow path when multiple nozzle segments are assembled around the turbine centerline 11. The turbine nozzle segments 23, when assembled in the engine, form an annular turbine nozzle assembly, with the inner and outer bands 51, 52 forming the annular flow path through which the hot gases pass. In the turbine 10 shown in FIG. 1, stage 2 turbine nozzle receives the flow coming out of the stage 1 turbine and reorients its direction and flows it into the stage 2 turbine.

Figure 3:
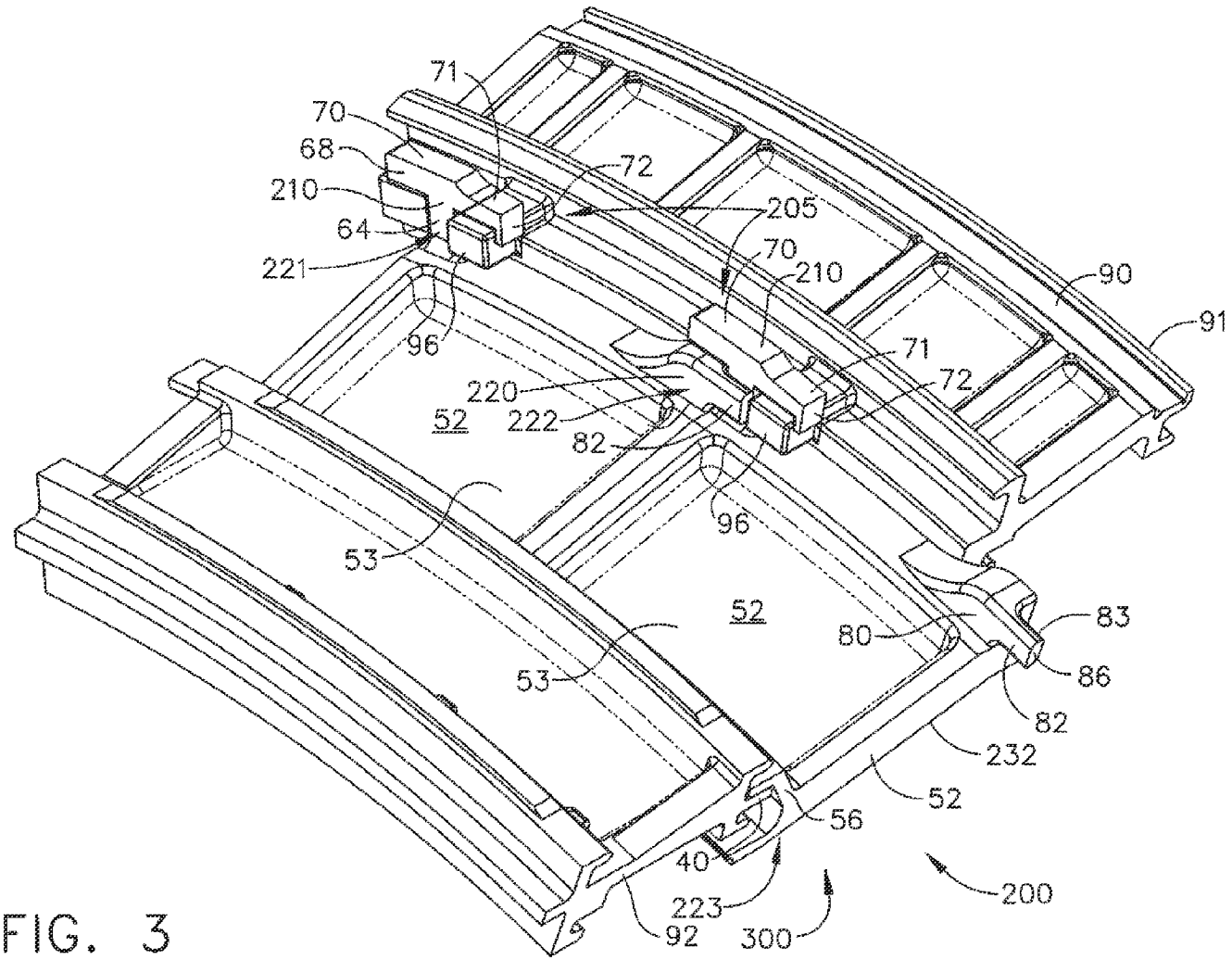
FIG. 3 shows an isometric view of a stator assembly having an exemplary embodiment of a stator mounting system according to the present invention.

Referring to FIGS. 2 and 3, the exemplary embodiment of the stage 2 nozzle shown therein is held in position by a stator support system 300. An exemplary outer band cantilever mount system is shown in FIGS. 1 and 2. In the exemplary embodiments shown, the axially forward end 61 of the outer band 52 has a forward hook 56 which extends in the circumferential direction along the circumferential length of the nozzle segment 23. The forward hook 56 sits on an arcuate rail 40 which protrudes axially from the aft end of the stage 1 shroud hanger 32.

FIG. 3 shows an isometric view of a stator assembly 200 having an exemplary embodiment of a stator components mounting system 300 according to the present invention. For illustration purposes, only two outer bands 52 that are circumferentially to each other are shown in FIG. 3. Each outer band 52 has a reaction mount system 205 comprising a stator hanger 210 located at a first location 221, such as near the aft end location shown in FIG. 3, and a stator stopper 220 at a second location 222. The stator stopper 220 is shown located circumferentially apart from the stator hanger 210, near the aft end on the outer bands 52. The support system 300 further comprises a hook 56 that is located at a third location 223, shown in FIGS. 2 and 3 near the axially forward end 61. As shown in FIG. 3, the forward hook may be have arcuate shape that engages with an arcuate rail 40 on a static structure 92 located near the forward hook 56. As shown in the figures herein, the arcuate rail 40 forms a part of a shroud hanger 32 located axially forward from the outer band 52.

Figure 4:
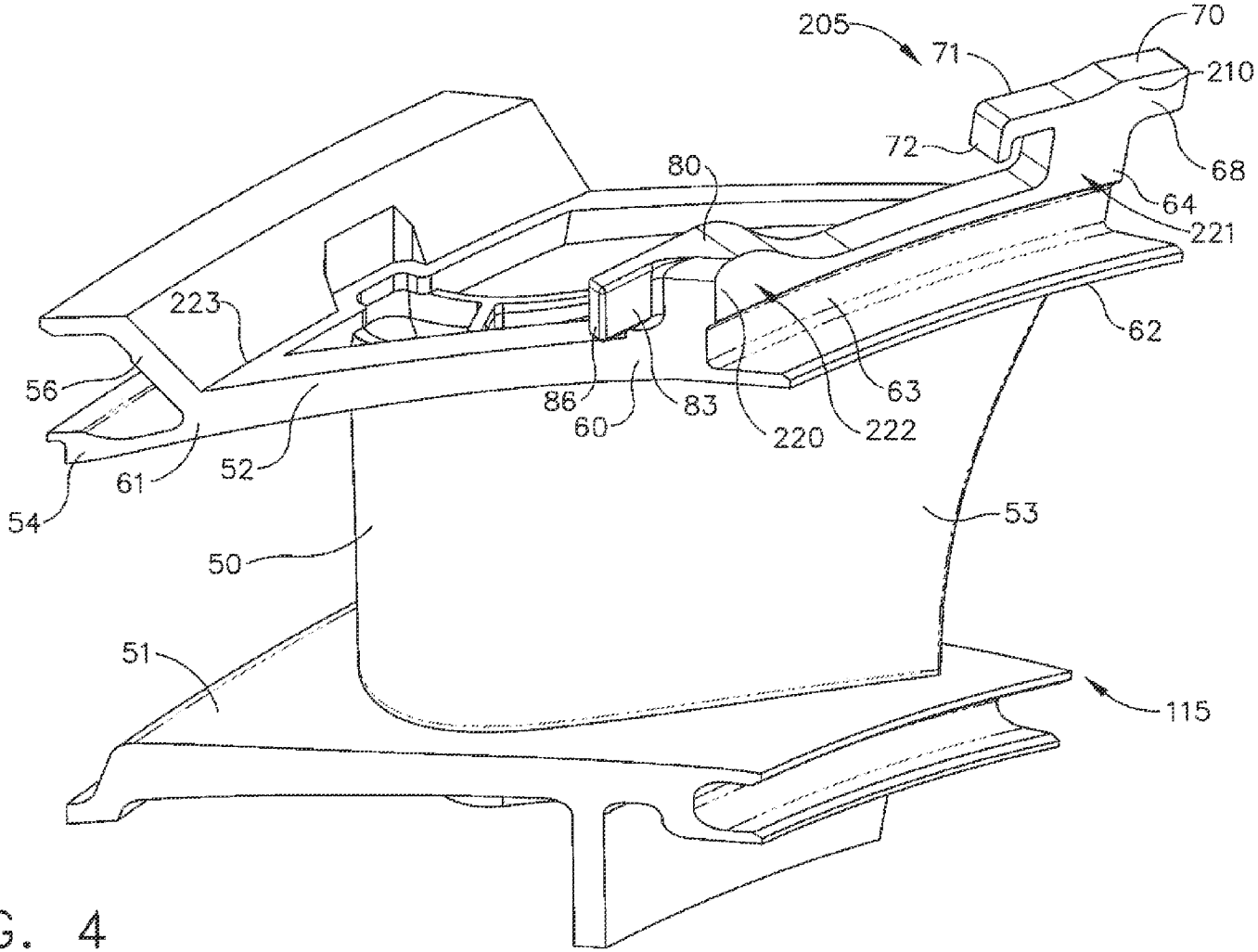
FIG. 4 shows an isometric view of a stator vane having a reaction mount system according to an exemplary embodiment of the present invention.

FIG. 4 shows an isometric view of a stator vane 53 having a reaction mount system 205 according to an exemplary embodiment of the present invention. The stator hanger 210 and the stator stopper 220 are located near the aft end 60 and the forward hook 56 is located near the forward end 61 of the outer band 52. The stator hanger 210 comprises a stem 64, having a block of material shaped like a hammer (herein referred to as "hammer", identified as item 68) located at its radially outer end. The stator hanger has a hanger claw 71 located near the radially outer end of the stem 64. The stator stopper 220 is located circumferentially apart from the stator hanger 210. The stator stopper 220 comprises a paddle 80 having a paddle aft face 83 and an end face 86.

During assembly, hanger claw 71 engages with a post 96 that is located on a first support structure 91, such as for example, a shroud hanger 90. The stator stopper 220 located on an outer band 52 engages, as shown in FIG. 3, with the stator hanger 210 located on the circumferentially adjacent outer band 52. Specifically the paddle aft face 83 is located adjacent to the stem 64 of the stator hanger 210. A portion of the top of the stator stopper 220 engages with a radially inner portion of the hammer 68. When the turbine is not operating, the hanger claw 71 rests on the post 96, providing support for the nozzle in the cold condition. In FIGS. 3 and 4, an anti-rotation tab 72 is shown located near an end of the hanger claw 71. The anti-rotation tab 72 engages with the post 96 to prevent rotation of the nozzle segments 23 during assembly.

During turbine operation the stem 64 of the hammer 68 reacts the nozzle tangential loads against the post 96. The top of the stator stopper 220 located at the second location 222 on the opposite slash face of the outer band 52 reacts the radial moment into the hammer 68 of the circumferentially adjacent outer band 52 of the adjacent nozzle segment 23. The top 70 of the hammer 68 reacts radially against a 360 degree shroud support. In addition to the hammer 68, the radial load is also reacted into supporting structure 92 by the nozzle forward hook 56. The axial moments are reacted by the paddle 80, into the hammer stem 64 of the adjacent nozzle segment, and into the adjacent supporting structure 91. Axial loads are reacted against the adjacent static structures such as the stage 2 shroud hanger. When the nozzle segments 23 are assembled into a full nozzle assembly, all of the nozzle segments will react the radial moment against the 360 degree shroud support and all of the axial loads and moments, and circumferential loads against the adjacent supporting structures. This feature of support system 300 improves the roundness of the nozzle assembly around the turbine axis 11 and results in a reduction of the relative gap between nozzle segments and is an improvement over prior art.

Figure 5:
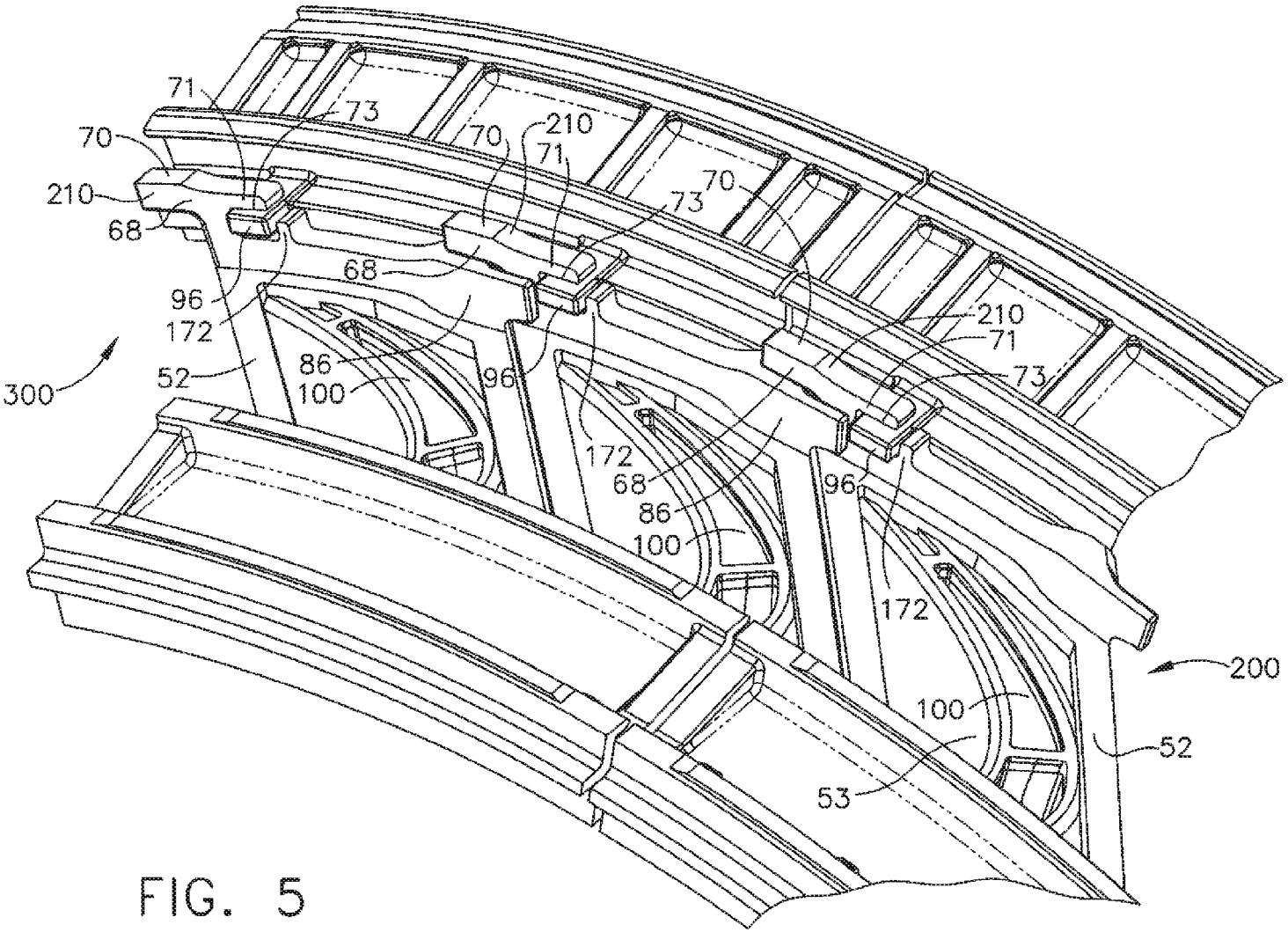
FIG. 5 shows an isometric view of a stator assembly having an alternative embodiment of a stator mounting system according to the present invention.
Figure 6:
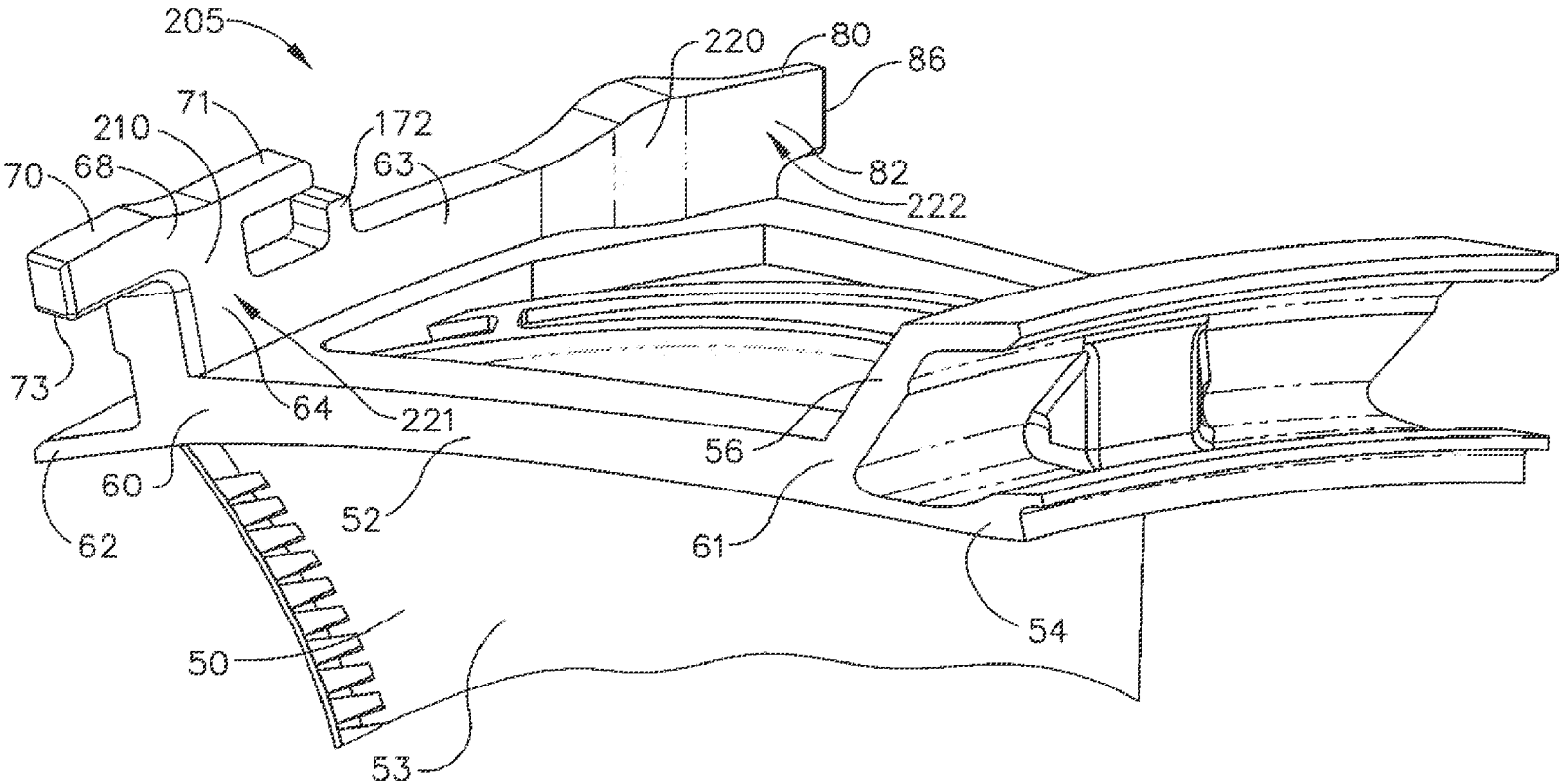
FIG. 6 shows an isometric view of a stator vane having a reaction mount system according to an alternative embodiment of the present invention.

FIG. 5 shows a stator assembly 200 having an alternative embodiment of a stator mounting system 300 according to the present invention. Three nozzle segments are shown, each segment having a single vane. The nozzle vanes 53 shown have hollow cavities through which cooling flow air is passed through. An alternative embodiment of the stator hanger 210 is shown in FIGS. 5 and 6. The hanger claw engages with a post 96 located on an adjacent supporting structure 91 such as a shroud hanger. In this alternative embodiment, the reaction mount system 205 has an anti-rotation tab 172 that is located on the reaction mount 63 (see FIG. 6). The engagement of the stator hanger 210 and the stator stopper 220 with the support structure 91 is as described previously.

Figure 7:
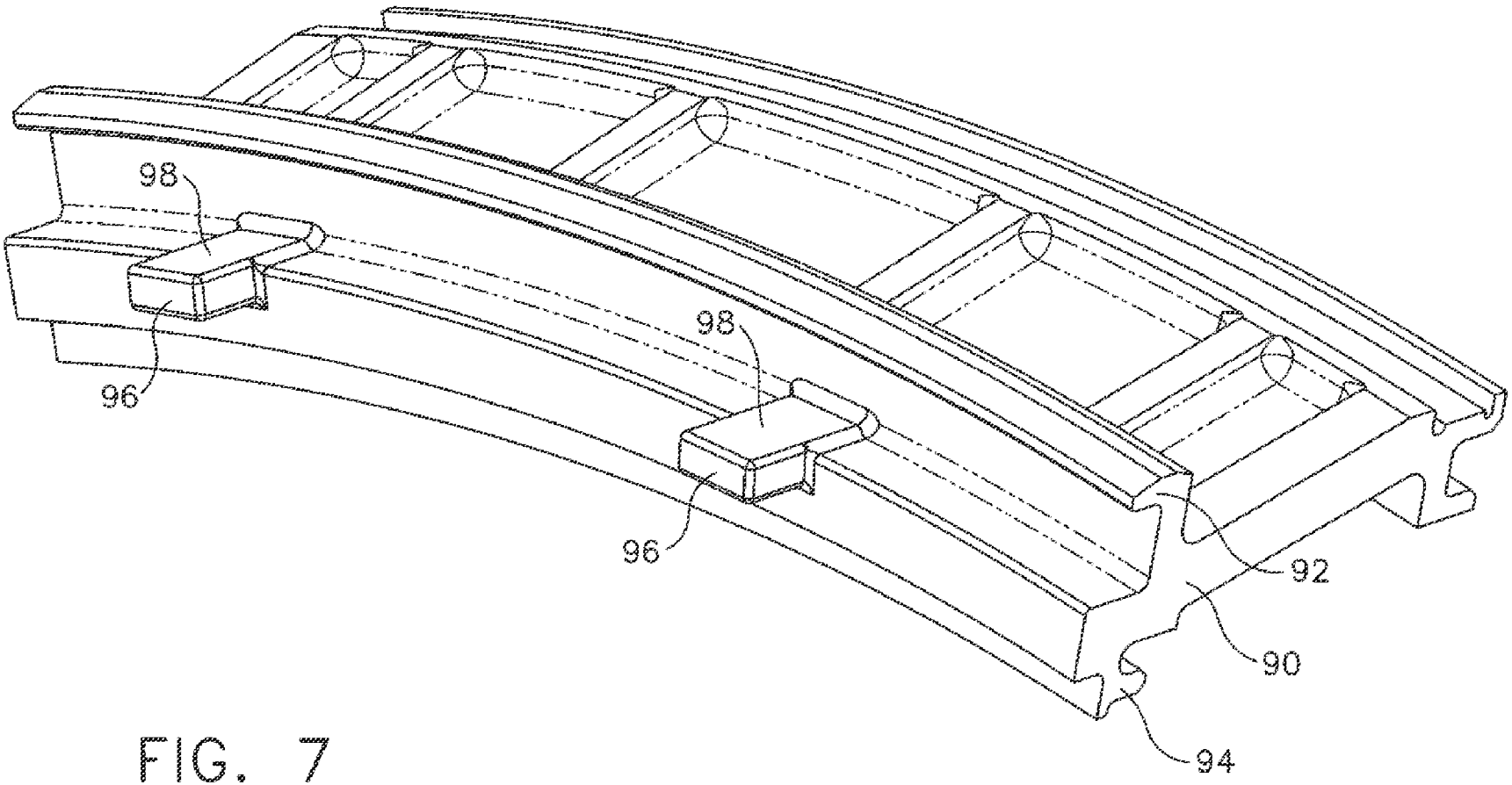
FIG. 7 shows an isometric view of a shroud hanger shown in FIG. 3.

FIG. 7 shows a shroud hanger 90 that can be used in the static component mount system 300 described herein. The shroud hanger 90 has an inner rail 94 that is arcuate in shape. The inner rail can support a conventional turbine shroud. The shroud hanger 90 has an outer rail that is also arcuate in shape. The outer rail engages with a casing 34 and reacts the loads against the casing 34. The shroud hanger has at least one post 96 that extends generally in an axial direction, as shown in FIGS. 3, 5 and 7. The post provides support for the stator vanes 23 as described previously and transmits the loads through the post 96 to the shroud hanger and the casing. The shroud hangers, and nozzles and other components shown herein are made of conventional turbine materials such as for example Rene 80 and Inconel 718 that have high temperature capabilities.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A stator assembly for a gas turbine engine comprising:

a stator vane having an airfoil;

an outer band located on a radially outer end of the airfoil;

a shroud hanger located axially adjacent to the outer band, the shroud hanger comprising a post wherein at least a portion of the post extends in an axial direction over a portion of the outer band;

a reaction mount system comprising a stator hanger located on the outer band at a first location and a stator stopper located at a second location that is located circumferentially apart from the first location;

the reaction mount system located on the outer band wherein the reaction mount system engages with the post to provide support for the stator vane;

the stator hanger comprising a stem, a hammer and a hanger claw; and, the stator stopper engages with the stem of the stator hanger located on a circumferentially adjacent outer band.

2. The stator assembly according to claim 1 wherein the hanger claw comprises an anti-rotation tab located at an end of the hanger claw.

3. The stator assembly according to claim 1 wherein the stator stopper comprises a paddle.

4. The stator assembly according to claim 1 further comprising an anti-rotation post located on a reaction mount.

5. The stator assembly according to claim 1 wherein the reaction mount system is located near the axially aft end of the outer band.

6. The stator assembly according to claim 1 wherein the hanger claw engages with the post.

7. The Stator assembly of claim 1 wherein a top of the hammer reacts radially against a 360 degree shroud support.

8. The Stator assembly of claim 7 wherein in addition to the hammer reacts radially, a radial load is also reacted into the reaction mount system by a nozzle forward hook.

* * * * *